US009532122B1

(12) United States Patent
Harris

(10) Patent No.: US 9,532,122 B1
(45) Date of Patent: Dec. 27, 2016

(54) TV SHELF WITH SPEAKERS

(71) Applicant: J. W. Harris, Winter Haven, FL (US)

(72) Inventor: J. W. Harris, Winter Haven, FL (US)

( * ) Notice: Subject to any disclaimer, the term of this patent is extended or adjusted under 35 U.S.C. 154(b) by 41 days.

(21) Appl. No.: 14/805,614

(22) Filed: Jul. 22, 2015

(51) Int. Cl.
*H04R 1/02* (2006.01)

(52) U.S. Cl.
CPC ..... *H04R 1/02* (2013.01)

(58) Field of Classification Search
CPC ..... A47B 81/06; A47B 81/061; A47B 81/062; A47B 81/064; A47B 81/065; A47B 2200/04; A47B 96/02; A47B 45/00; A47B 97/00; H04R 5/02; H04R 1/02; H04R 1/025; H04R 1/026; H04R 2499/15; H04N 5/64; F16M 13/02; G06F 1/16; G06F 1/1601; H05K 5/0204; H05K 7/14
See application file for complete search history.

(56) References Cited

U.S. PATENT DOCUMENTS 5,326,061 A 7/1994 Hamilton
5,788,200 A 8/1998 Jones
6,056,083 A 5/2000 Daniell
7,530,538 B2 5/2009 Whalen et al.
7,676,992 B2 3/2010 Burns
8,270,652 B2 9/2012 Caldes et al.
2007/0154041 A1* 7/2007 Beauchamp ..... H04R 5/02 381/306
2007/0193481 A1* 8/2007 Wiebe ..... A47B 96/06 108/152
2011/0110540 A1* 5/2011 Mispelkamp ..... A47B 81/06 381/120

FOREIGN PATENT DOCUMENTS

KR 20020075480 A * 10/2002

* cited by examiner

*Primary Examiner* — Thang Tran
(74) *Attorney, Agent, or Firm* — Molly D. McKay

(57) ABSTRACT

The present invention is a wall mounted shelf that is capable of holding a heavy flat-panel television set and associated accessories. The shelf is hollow and contains speakers mounted within the hollow interior of the shelf to provide enhanced sound production for the television. The shelf mounts on a mounting bracket that attaches to the wall's studs via screws and that is completely concealed by the shelf. The mounting bracket has vertical bracing that engages the wall to prevent sagging of the shelf and horizontal pipes that insert into pipe receivers provided within the hollow shelf to provide additional support for the shelf.

10 Claims, 2 Drawing Sheets

TV SHELF WITH SPEAKERS

BACKGROUND OF THE INVENTION

1. Field of the Invention

The present invention is a wall mounted shelf that is capable of holding a flat-panel television set and associated accessories. The shelf is hollow and contains speakers mounted within the hollow interior of the shelf to provide enhanced sound production for the television.

2. Description of the Related Art

Various shelves are on the market. Many are small and do not have the capacity to hold large, heavy objects such as large, flat-panel television sets that are to sit on their original equipment manufacturer (OEM) provided feet or stand. Those steel TV mounts that are sufficiently strong to hold heavy objects normally must be secured to a wall with large lag bolts. Use of such wall anchors makes these shelves difficult to mount and is not permitted in most rental houses and apartments where the large holes left behind by these type of wall anchors when the shelves are removed is undesirable.

The present invention addresses this need by providing a shelf that can be mounted on a wall using standard screws that engage wall studs in the wall on which the shelf is to be mounted. Because standard screws are employed, when the shelf is removed, the only damage to the wall are eight screw holes that can be easily filled and repaired.

Another problem with shelves is that they sag after they are mounted on a wall, sometimes sagging just from the weight of the shelf itself and sagging even more when the shelf is loaded with heavy objects. The present invention addresses this problem by providing a unique wall mounting system that supports the shelf so that it does not sag downward, even when a heavy television is sitting on the shelf.

Further, televisions are not generally provided with high quality speakers and the speakers are often mounted within the television cabinet so that the speakers fire rearward toward the wall or toward the sides of the television, producing inferior sound and dialogue that is difficult to interpret. Sound production can be greatly improved by adding multiple and varied types of speakers that are available in the market and mounting those speakers so that they fire in a desired orientation.

However, when adding speakers to a television set, there is always the problem of where to mount the speakers so that they are properly oriented. Mounting speakers to the wall causes additional damage to the wall on which they are mounted.

Also, it is desirable to arrange the speakers so that they can be hidden from view because the speaker and the wiring leading to the speakers is unattractive. The present invention addresses these problems by providing a hollow shelf in which multiple speakers can be installed so that the speakers are aimed in the proper orientation so as to produce the best sound and clarity and so that the wiring leading to the speakers are concealed within the hollow shelf.

In addition to holding a television, it would be desirable to have a shelf where amplifiers, DVD players, cable boxes, satellite receivers, iPods® or Mini iPads®, or other pieces of equipment could be mounted in close proximity to the television and so that the wiring connecting the player and television ware concealed. The present invention addresses this need by providing additional shelf space located within the hollow shelf and opening at the front so that the amplifier can be inserted therein and having an opening at the rear so that the wiring is concealed from view.

SUMMARY OF THE INVENTION

The present invention is a wall mounted shelf that is capable of holding a flat-panel television set and associated accessories. The shelf is hollow and contains speakers mounted within the hollow interior of the shelf to provide enhanced sound production for the television. The shelf mounts on the wall with standard screws that engage studs located in the wall where the shelf is to be mounted. Optionally, the shelf can be designed with an additional shelf located within the hollow shelf frame for placing amplifiers, DVD players, cable boxes, satellite receivers, iPods® or Mini iPads® or other type of equipment so that wiring is concealed. The shelf is provided with openings on the top 12 and bottom of the shelf to allow for electrical connections, cable connections, and wiring from the television to speakers, amplifiers, DVD players, cable boxes, satellite receivers, iPods® or Mini iPads®, etc.

The present invention is a wall-mounted shelf for supporting a flat-panel television on its OEM supplied stand or feet. The shelf mounts on a wall and provides better audio performance due to superior speaker design than is available in flat panel televisions. Unlike television mounts that utilize large diameter lag-bolts to secure the TV to the wall, the speaker shelf utilizes eight small screws to secure the shelf to the wall. The speakers of the shelf can be driven by any number of amplifiers as small as 5 watts and up to 100 watts root mean square (RMS) per channel.

The shelf can be constructed of wood, plastic or other suitable material that has suitable acoustic enclosures to contain loudspeaker components and crossover networks that direct sound frequencies to the appropriate driver. Designs may include single full-range drivers and or tweeters, woofers and midrange components.

To optimize sonic performance, channel separation, detail and directionality the mid frequency and high frequency drivers (midrange & tweeters) fire forward into the listening room toward the listener. Optionally, additional down firing woofers can be provided in the shelf that produce low frequency sounds, i.e. under 700 Hz, employing the psychoacoustic effect of non-directionality. This gives the listener the impression that the low frequencies are coming from the left and right stereo speakers enhancing the overall experience. The down firing placement fits into the hollow shelf enclosure and a dual voice coil woofer will yield low frequency detail from both left and right channel stereo sources.

The shelf is supported by a mount made of a horizontal steel bar and having long steel pipes extending outward perpendicular from the horizontal bar. The pipes are preferably about a foot long and are designed to insert into hollow receiving members providing within the shelf as the shelf is slid onto the mount. The hollow receiving members may be constructed of PVC pipe that is mounted within the hollow interior of the shelf. The entire mount will be concealed by the shelf when the shelf is installed on it. The PVC pipes mounted in the shelf receive the steel pipes, thereby providing additional support and rigidity to the shelf.

The horizontal steel bar to which the pipes are welded has additional vertical supports of steel that extend downward perpendicular to the length of the horizontal bar so that both the horizontal bar and the vertical supports engage the wall on which the shelf is to be mounted to provide strain relief.

This prevents the shelf from sagging or tipping downward while supporting the weight of the shelf and television or decorator items. The horizontal bar has holes drilled along its length to fasten the mount to the wood or steel framing studs in walls. These holes are on 16" centers which match the typical construction framing found in homes and apartments in North America. This mount is intended to be affixed to the structural stud inside the walls of a room. The various models of shelves with speakers weigh up to about 30 lbs. and each shelf will support its own weight and also support the weight of a medium size, flat-panel television and other non-speaker accessories ranging up to about 60 lbs.

DETAILED DESCRIPTION OF THE PREFERRED EMBODIMENT

Figure 1:
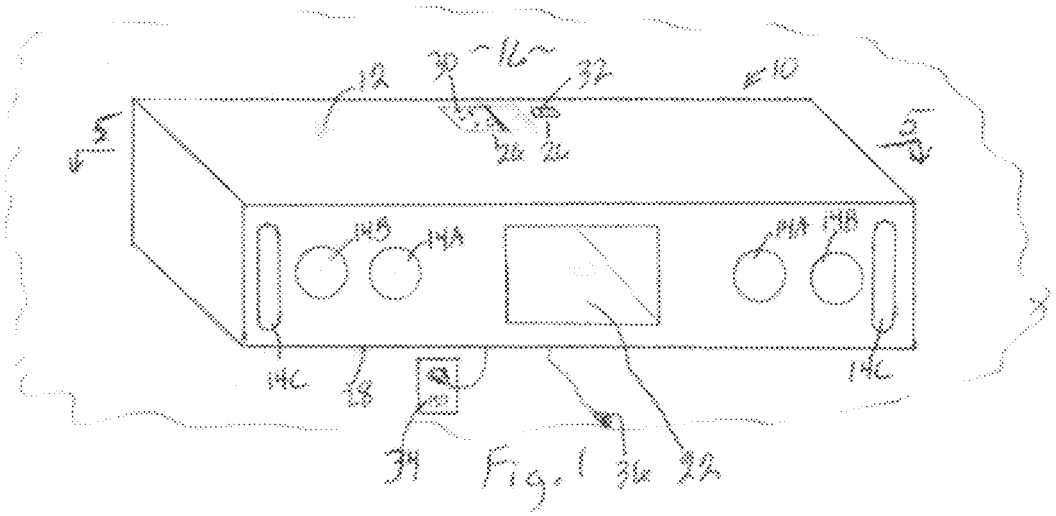
FIG. 1 is an isometric frontal view of a shelf constructed in accordance with a preferred embodiment of the present invention shown mounted to a wall of a building.

Referring now to the drawings and initially to FIG. 1, there is illustrated a wall-mounted shelf 10 that is constructed in accordance with a preferred embodiment of the present invention. The shelf 10 is capable of holding a flat-panel television set (not illustrated) which sits on top 12 of the shelf 10 on its original equipment manufacturer (OEM) supplied stand or feet and capable of holding associated television accessories such as amplifiers, DVD players, cable boxes, satellite receivers, iPods® or Mini iPads®, etc. (also not illustrated).

Figure 5:
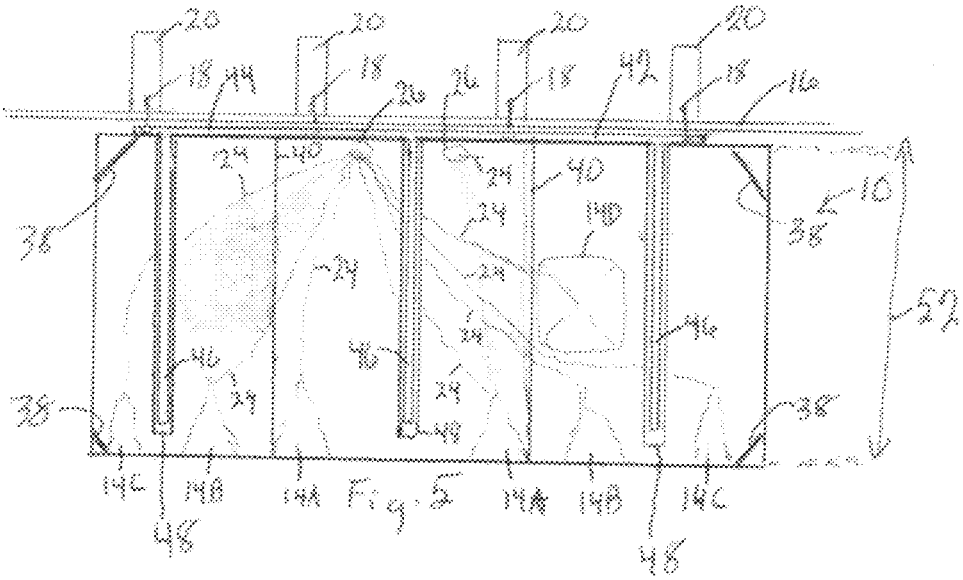
FIG. 5 is a cross sectional view of the shelf taken along line 5-5 of FIG. 1 showing the shelf mounted on the mounting bracket which is mounted to the wall studs.

Referring also to FIG. 5, the shelf 10 is hollow and contains speakers 14A, 14B, 14C and 14D mounted within the hollow interior of the shelf 10 to provide enhanced sound production for the television. The shelf 10 mounts on a wall 16 with standard screws 18 that engage studs 20 located within the wall 16 where the shelf 10 is to be mounted.

As illustrated in FIG. 1, optionally the shelf 10 can be designed with an additional shelf 22 located within the hollow frame of the shelf 10 for placing an amplifier so that wiring 24 is concealed. The shelf 10 is provided with openings 26 on the top 12 and on the bottom 28 of the shelf 10 to allow for electrical connections, cable connections, and wiring from the television to speakers 14A, 14B, 14C and 14D and to amplifiers, DVD players, cable boxes, satellite receivers, iPods® or Mini iPads®, etc.

Figure 3:
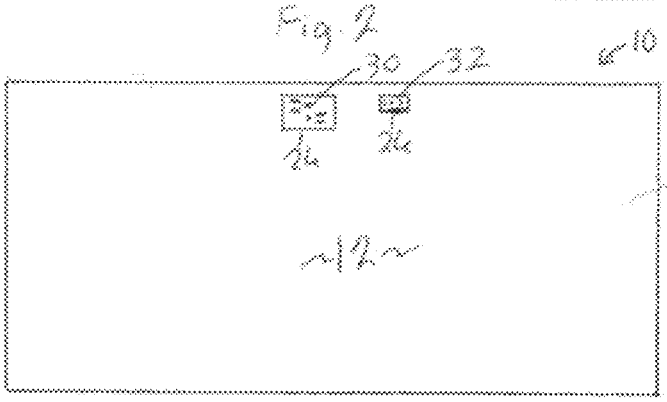
FIG. 3 is a top plan view of the shelf of FIG. 1.

Referring to FIG. 3, the top 12 of the shelf 10 is optionally provided in one of the openings 26 with electrical outlets 30 into which the television and any associated equipment can be plugged. Also provided on the top 12 of the shelf 10 in one of the openings 26 is a connection for power cable or a USB port 32. The USB port 32 is for charging or powering a 5V device like a Bluetooth® accessory board, or for charging an iPods® or Mini iPads® or a variety of audio devices.

Figure 2:
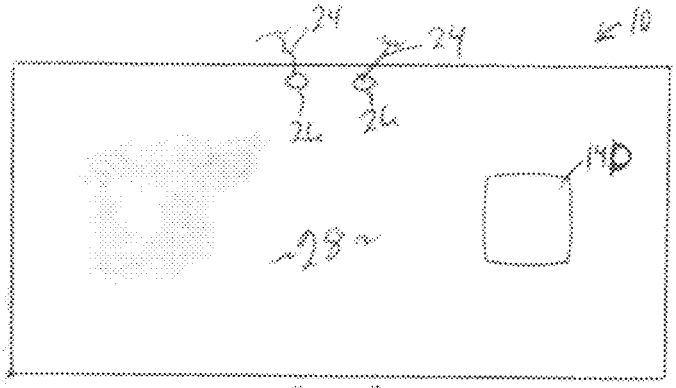
FIG. 2 is a bottom plan view of the shelf of FIG. 1.

As shown in FIG. 2, the bottom 28 of the shelf 10 is also provided with openings 26 allowing access between electrical outlets 34 and cable connections 38 in the wall 16 and the interior of the shelf 10 so that the appropriate electrical, cable and wiring connections can be made for the television and associated equipment.

The shelf 10 mounts on the wall 16 and provides better audio performance due to superior speaker design than is available in flat panel televisions. Unlike television mounts that utilize large diameter lag-bolts to secure the TV to the wall 16, the speaker shelf 10 utilizes eight small screws 18 to secure the shelf 10 to the wall 16. The speakers 14A, 14B, 14C and 14D of the shelf 10 can be driven by any number of amplifiers as small as 5 watts and up to 100 watts root mean square (RMS) per channel.

The shelf 10 can be constructed of wood, plastic or other suitable material. The shelf 10 may be provided internally with bracing 38 and support structures 40 to provide strength and rigidity to the shelf 10. The shelf 10 is hollow and is provided with suitable acoustic enclosures to contain loudspeaker components 14A, 14B, 14C, and 14D and crossover networks that direct sound frequencies to the appropriate driver. Designs may include single full-range drivers and or tweeters, woofers and midrange components. Because the number and arrangement of speakers 14A, 14B, 14C and 14D can vary, the drawings illustrate a typical speaker arrangement for purpose of illustration only and not as a limitation.

Referring to FIGS. 1 and 2, to optimize sonic performance, channel separation, detail and directionality the mid frequency and high frequency drivers 14A, 14B and 14C (midrange & tweeters) fire forward into the listening room toward the listener. Optionally, one or more additional down firing woofers 14D can be provided in the shelf 10 that produce low frequency sounds, i.e. under 700 Hz, employing the psycho-acoustic effect of non-directionality. This gives the listener the impression that the low frequencies are coming from the left and right stereo speakers 14A, 14B and 14C enhancing the overall experience. The down firing placement fits into the hollow enclosure of the shelf 10 and a dual voice coil woofer 14D will yield low frequency detail from both left and right channel stereo sources.

Figure 4:
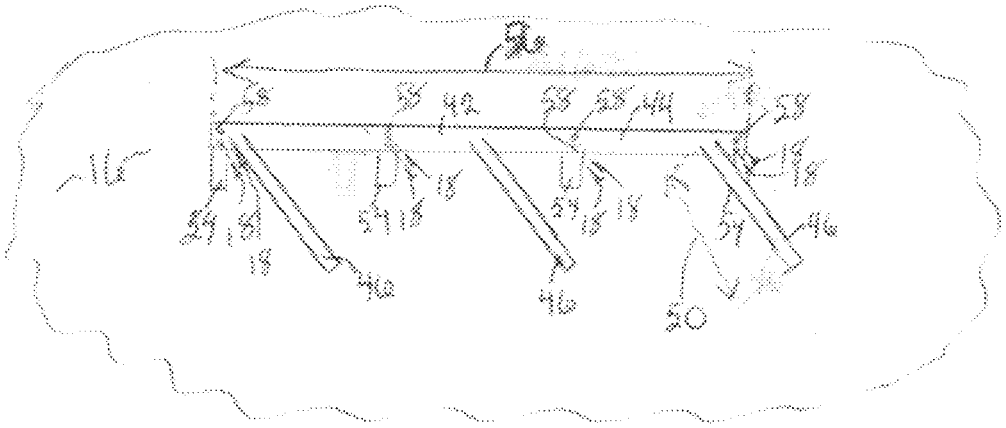
FIG. 4 is an isometric frontal view of the mounting bracket for the shelf of FIG. 1 shown being mounted to a wall of a building with screws.

As shown in FIGS. 4 and 5, the shelf 10 is supported by a mounting bracket 42 made of a horizontal steel bar 44 and having long steel pipes 46 welded to and extending outward perpendicular from the horizontal bar 44. The pipes 46 are preferably about a foot long and are designed to insert into hollow pipe-receiving members 48 providing within the shelf 10 as the shelf 10 is slid onto the mounting bracket 42. The hollow receiving members 48 may be constructed of PVC pipe that is mounted within the hollow interior of the shelf 10. The entire mounting bracket 42 will be concealed by the shelf 10 when the shelf 10 is installed on it. Once the shelf 10 is slid onto the steel pipes, gravity causes it to rests there without any further means of fastening the shelf 10 to the bracket 42. The length 50 of the pipes 50 extend substantially across the entire depth 52 of the shelf 10. The PVC pipes 48 mounted within the shelf 10 and the steel pipes 46 that are received therein provide additional support and rigidity to the shelf 10.

The horizontal steel bar 44 to which the pipes 46 are secured has additional vertical supports 54 of steel that extend downward perpendicular to the length 56 of the horizontal bar 44 so that both the horizontal bar 44 and the vertical supports 54 engage the wall 6 on which the shelf 10 is to be mounted to provide strain relief. This prevents the shelf 10 from sagging or tipping downward while supporting the weight of the shelf 10 and the weight of the television or decorator items.

The mounting bracket 42 is intended to be affixed to the structural studs 20 located inside the walls 16 of a room. The horizontal bar 44 has screw holes 58 provided in it along its length 56 to fasten the mounting bracket 42 to the wood or steel framing studs 20 in the wall 16 via screws 18. These screw holes 58 are on sixteen inch centers which match the typical construction framing found in homes and apartments in North America. Preferably, the vertical supports 54 are provided on the bar 44 so that they align vertically with the screw holes 58 and the vertical supports 54 rest against the wall 16 overlying the studs 20.

The various models of shelves 10 with speakers 14A, 14B, 14C and 14D weigh up to about 29 lbs. and each shelf 10 will support its own weight and also support the weight of a medium size, flat-panel television and other non-speaker accessories ranging up to about 60 lbs.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A television shelf with speakers comprising:

a hollow shelf, at least one speaker mounted in said hollow shelf, and a mounting bracket having horizontally extending pipes, said hollow shelf provided internally with hollow pipe-receiving members into which the horizontally extending pipes insert as a means of fastening the shelf to the mounting bracket.

2. A television shelf with speakers according to claim 1 further comprising:

said mounting bracket having a horizontal bar to which the horizontally extending pipes attached so that the pipes are perpendicular to the bar, and said horizontal bar provided with screw holes through which fasteners insert to secure the mounting bracket to studs in a wall.

3. A television shelf with speakers according to claim 1 further comprising:

downwardly extending vertical supports provided on the horizontal bar, said vertical supports vertically aligned with the screw holes, and said vertical supports oriented perpendicular to the horizontally extending pipes.

4. A television shelf with speakers according to claim 1 further comprising:

said hollow shelf provided internally with braces and support structures to provide strength to the hollow shelf.

5. A television shelf with speakers according to claim 1 wherein at least one speaker is mounted within the shelf to be front firing.

6. A television shelf with speakers according to claim 5 wherein at least one speaker is mounted within the shelf to be downwardly firing.

7. A television shelf with speaker according to claim 1 further comprising:

a top of the shelf and a bottom of the shelf each provided with openings to provide wiring passageways between the interior and the exterior of the shelf.

8. A television shelf with speaker according to claim 7 further comprising:

said openings in the top of the shelf provided with at least one electrical outlet and at least one cable connection.

9. A television shelf with speaker according to claim 1 further comprising:

at least one additional shelf provided within the hollow shelf.

10. A television shelf with speaker according to claim 1 wherein said shelf is capable of supporting a 60 lb. object in addition to its own weight.

* * * * *